US006269592B1

(12) United States Patent
Rutter

(10) Patent No.: US 6,269,592 B1
(45) Date of Patent: Aug. 7, 2001

(54) GUTTER SHIELD

(76) Inventor: Kenneth M. Rutter, 16 West Oak Hill La., Hendersonville, NC (US) 28739

( * ) Notice: Subject to any disclaimer, the term of this patent is extended or adjusted under 35 U.S.C. 154(b) by 0 days.

(21) Appl. No.: 09/542,742

(22) Filed: Apr. 4, 2000

(51) Int. Cl.[7] ..... E04D 13/076
(52) U.S. Cl. ..... 52/12; 52/712; 248/48.1
(58) Field of Search ..... 52/12, 712; 248/48.1, 248/48.2

(56) References Cited

U.S. PATENT DOCUMENTS

| | | | | |
|---|---|---|---|---|
| 4,404,775 | | 9/1983 | Demartini | 52/12 |
| 4,435,925 | * | 3/1984 | Jefferys | 52/12 |
| 4,455,791 | | 6/1984 | Elko et al. | 52/12 |
| 4,796,390 | * | 1/1989 | Demartini | 52/12 |
| 5,459,965 | | 10/1995 | Meckstroth | 52/12 |
| 5,495,694 | * | 3/1996 | Kuhns | 52/12 |
| 5,575,118 | * | 11/1996 | Vahldieck | 52/11 |
| 5,640,809 | * | 6/1997 | Iannelli | 52/12 |
| 5,660,001 | * | 8/1997 | Albracht | 52/12 |
| 5,737,879 | * | 4/1998 | Sweet | 52/12 |
| 5,911,659 | | 6/1999 | Serano | 52/12 |
| 6,016,631 | * | 1/2000 | Lowrie, III | 52/12 |
| 6,098,344 | * | 8/2000 | Albracht | 52/12 |

* cited by examiner

*Primary Examiner*—Robert Canfield
(74) *Attorney, Agent, or Firm*—Joseph T. Guy; Nexsen Pruet Jacobs & Pollard LLC

(57) ABSTRACT

An improved gutter shield is provided which allows water to run into a gutter while forbidding foreign material, such as leaves, from entering the gutter. The shield comprises an elongated gutter shield comprising a curl. A mounting clip is provide which comprises a gutter mounting tab; a downward leg attached to the gutter mounting tab and extending downward therefrom and a riser leg attached to the downward leg and extending upward therefrom. The gutter mounting tab is attachable to the gutter and the riser leg is attachable to the curl of the elongated gutter shield.

17 Claims, 3 Drawing Sheets

GUTTER SHIELD

BACKGROUND

The present invention is related to a gutter shield which allows water to enter the gutter while forbidding the entrance of foreign debris, such as leaves, sticks and the like. More specifically, the present invention is directed to an improved gutter shield system which has improved properties and an improved mounting system.

The use of shields on rain gutters is well known and a variety of shields and shield mounting systems are available. Shields manufactured from a single piece which either snap into a gutter or are integral to the gutter are provided in, for example, U.S. Pat. Nos. 5,911,659; 5,737,879 and 5,575,118. Gutter shields which are pre-formed and snap into a gutter are undesirable since gutters are available in many cross-sectional shapes and sizes and the installer must maintain an inventory of parts or not participate in some business opportunities. Gutter shields which are integral to the gutter typically require that the entire gutter be replaced since they can not be retrofit to an existing gutter. It is now a common practice in the art to form gutters at the installation site from rolls of flat metal. This practice saves cost and eliminates the need to form seams in gutters since the entire gutter can be manufactured to the appropriate length on site. The shapes required to form a gutter, with the shield integral thereto, are not compatible with this practice.

Gutter shields which can be added to existing gutters are provided in, for example, U.S. Pat. Nos. 4,455,791; 4,404,775 and 5,459,965. These typically include an elongated flat cover with one end placed under the shingles of the house and the other end rolled under and secured to the gutter. The manner in which these devices are secured is deficient for a variety of reasons. U.S. Pat. No. 4,455,791 teaches a series of straps which are on top of the gutter shield. The gutter shield rest on the spikes which secure the gutter to the building. This is unsightly and requires that spikes be used to secure the gutter to the building. Spikes are not always appropriate. U.S. Pat. No. 4,455,791 also teaches an embodiment wherein a clip secures the gutter shield to the gutter. This method is not secure and wind can dislodge the gutter shield which is undesirable.

An improved gutter shield and mounting clip is provided in the present invention which eliminates the problems associated with existing systems.

SUMMARY

It is an object of the present invention to provide a gutter shield and mounting clip which is superior to those presently available in the art.

It is another object of the present invention to provide a gutter shield mounting clip which is easy to install and which is secure.

A particular feature of the present invention is that the mounting clip is not readily visible and is therefore more aesthetically pleasing Than mounting clips of the prior art.

These and other features, as will be apparent, are provided in a shield for eliminating debris from entering a gutter. The shield comprises an elongated gutter shield comprising a curl. A mounting clip is provide which comprises a gutter mounting tab; a downward leg attached to the gutter mounting tab and extending downward therefrom and a riser leg attached to the downward leg and extending upward therefrom. The gutter mounting tab is attachable to the gutter and the riser leg is attachable to the curl of the elongated gutter shield.

Another embodiment is provided in a shield for eliminating debris from entering a gutter. The shield comprises an elongated gutter shield comprising a long edge and a short edge and a curl along one long edge. An elongated strap mounting clip is provided which comprises a planar gutter mounting tab; a downward leg attached to the gutter mounting tab and extending downward therefrom; and a riser leg attached to the downward leg and extending upward therefrom. The gutter mounting tab is attachable to the gutter and the riser leg is attachable to the curl.

In yet another embodiment a shield for eliminating debris from entering a gutter is provided wherein the gutter comprises an exterior edge. The shield comprises an elongated gutter shield comprising a curl. The mounting clip comprises a gutter mounting tab; a downward leg attached to the gutter mounting tab and extending downward therefrom; and a riser leg attached to the downward leg and extending upward therefrom. The gutter mounting tab is attachable to the exterior edge of the gutter and the riser leg is attachable to the curl.

DETAILED DESCRIPTION

The invention will be described in reference to the figures wherein similar elements are numbered accordingly.

Figure 1:
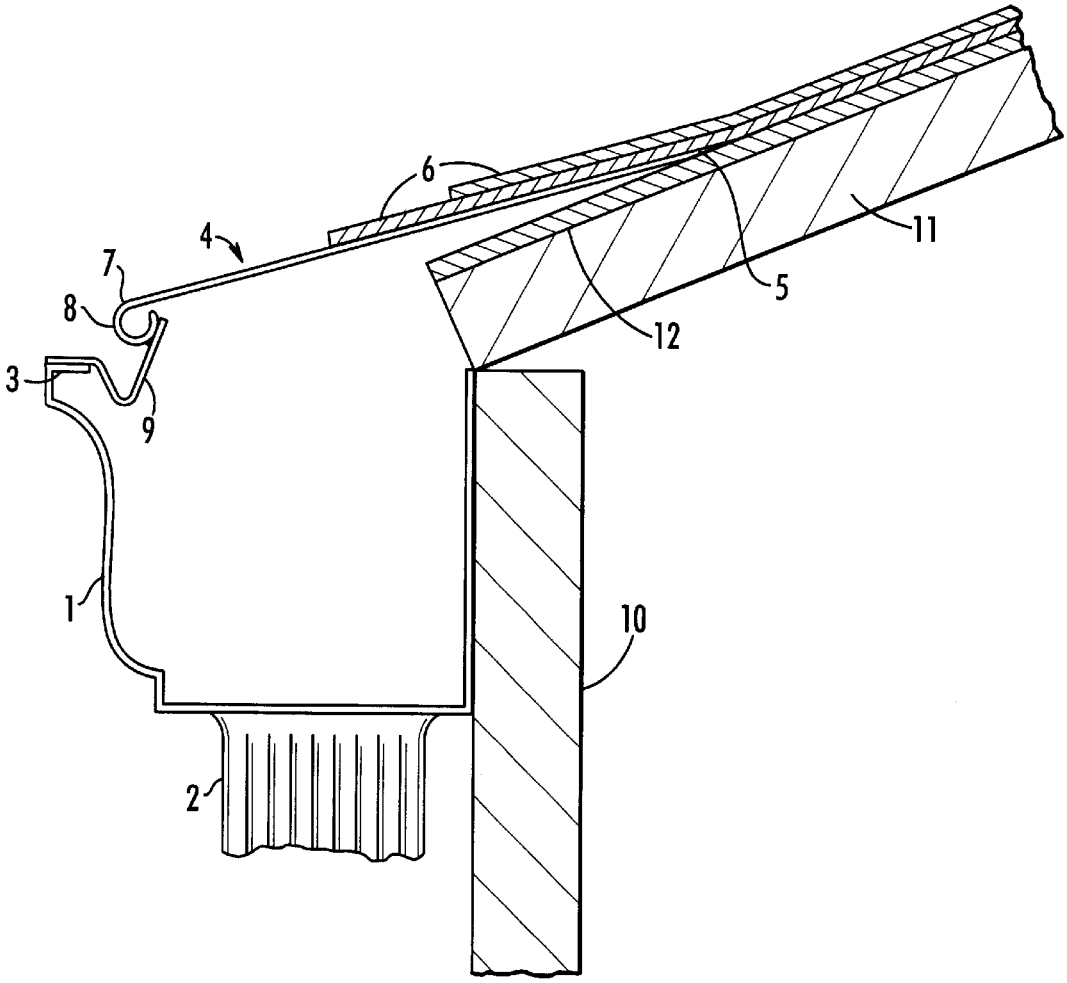
FIG. 1 is a cross-sectional view of the inventive gutter shield system of the present invention.

FIG. 1 illustrates an embodiment of the present invention. In FIG. 1, the gutter, 1, generally forms a trough which is attached to a downspout, 2, as well known in the art. Water that is captured in the gutter falls into the downspout and is directed away from the building. The gutter typically comprises a ledge, 3, which is approximately horizontal. The gutter shield, 4, is an elongated member which covers the open top of the gutter. The interior edge, 5, of the gutter shield, 4, is preferably installed under at least one row of shingles, 6. Water travels down the roof due to the slope thereof and at the end of the shingles, 6, the water travels down the gutter shield, 4. At the exterior edge, 7, of the gutter shield, 4, is a curl, 8, which redirects the water down and back towards the gutter, 1, wherein the water falls and is gathered for removal through the downspout, 2. Debris, such as leaves, and the like, slide off of the gutter shield and beyond the gutter and are therefore excluded from entering the gutter. The gutter shield, 4, is attached to the gutter, 4, by a mounting clip, 9, which will be described in more detail. The gutter is typically attached to a facia board, 10, of the building as known in the art. The roof typically comprises a plywood sheet, 11, which is overlaid with felt, 12. The manner in which the gutter is attached to the building is not limiting and any of the common methods of attaching a gutter to a building are suitable for demonstrating the present invention.

Figure 3:
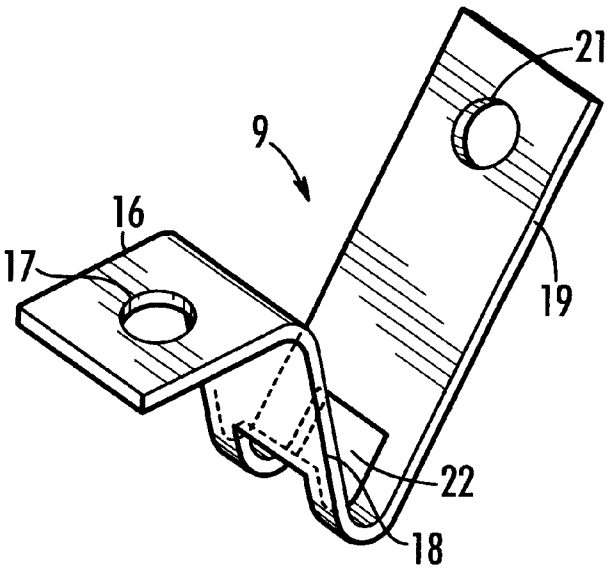
FIG. 3 is a perspective view of an embodiment of the gutter shield mounting clip of the present invention.
Figure 2:
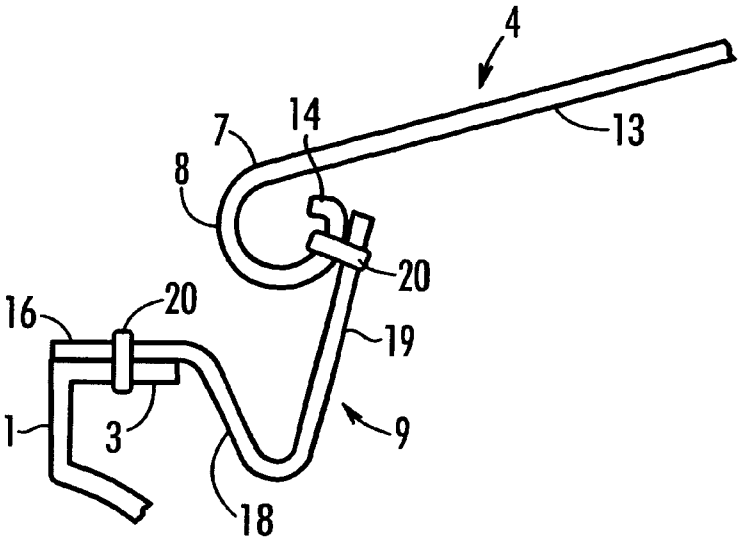
FIG. 2 is a cross-sectional view of an embodiment of the gutter shied mounting clip of the present invention.

FIG. 2 is a cross-sectional view of an embodiment of the mounting clip, 9, and the relationship of the mounting clip to the gutter, 1, and gutter shield, 4. FIG. 3 is a perspective view of the mounting clip, 9. The gutter shield, 4, comprises a planar section, 13, which acts as a slide for the water. At the exterior edge, 7, the gutter shield is turned under to form a curl, 8. The curl preferably forms a semicircle with a diameter of from at least approximately 0.25 inches to no more than approximately 1.0 inch. More preferably the curl forms a semicircle with a diameter of at least 0.75 inches to no more than 1.0 inch. The curl extends around at least 180° from the point at which it begins the turn to the grip ledge, 14. The grip ledge, 14, provides strength to the gutter shield and provides a grip location for turning the flat plate around a form to create a semicircle, or similar shape, as known in the art. Most preferably, the curl extends around a semicircle to less than 360° from the point at which it begins the turn. Most preferably the curl extends around a semicircle to at least 220° to no more than 300°. Approximately 270° is most preferred. The curl is preferably round but a series of bends can be used if desired without departing from the scope of the invention. The purpose of the curl is to persuade water to follow the curl and fall into the gutter. Any shape consistent with this purpose is suitable for the purposes of the present invention. The gutter shield is installed such that the outer extent of the curl would align with the inside gutter edge, 15. The outer extent of the gutter shield is defined as the vertical line tangent to the curl furthest from the interior edge. By installing the gutter shield such that the outer extent of the curl aligns with the inside gutter edge the maximum protection is afforded. If a high volume of water is flowing the water which only traverses a short portion of the curl will still be captured yet debris will not enter the gutter. It is most preferable that the outer extent be within 0.5 inches of the inside gutter edge and more preferably the outer extent is within 0.25 inches of the inside gutter edge.

The mounting clip, 9, is an elongated strap comprising a gutter mounting tab, 16, with an alignment hole, 17, through which the mounting clip is secured to the gutter ledge, 3. The gutter mounting tab is preferably planar but a cross-sectional shape that conforms with, or compliments, the contour of the gutter ledge is within the scope of the invention. At the end of the mounting tab, 16, the mounting clip turns down at a downward leg, 18, and then redirects upward in a riser leg, 19, which attaches to the curl, 8. An attachment hole, 21, is preferably provided. If the clip is above the gutter ledge water splashes, or channels, over the gutter which defeats the purpose of the gutter. The mounting tab, 16, of the mounting clip is attached to the ledge, 3, and curl, 8, by securing devices, 20, such as a rivet, screw, or the like. Rivets and self tapping screws are most preferred. An optional, but preferred, passage void, 22, is provided in the mounting clip to allow water to pass into the gutter with minimal interference from the mounting clip. The passage void may be in the downward leg, the riser leg or both. A multiplicity of passage voids may be employed without departing from the scope of the invention. The clip may be manufactured by stamping from a flat plate. The clip is preferably stamped from a rectangular flat plate. The flat plate is typically chosen to provide a mounting clip of the appropriate size. The mounting clip is preferably at least 0.25 inches to no more than 1 inch wide. Below 0.25 inches wide the clip strength may be insufficient and above 1 inch wide the clip comprises excess material which adds to cost with no net benefit in use. Most preferably the mounting clip is at least 0.375 inches wide to 0.625 inches wide. The length of the clip is based on the style of gutter but, in practice, a mounting clip of at least 1 inch to no more than 3 inches has proven to be satisfactory for most uses. More preferably the mounting clip has a length of 2 inches to 2.5 inches. The passage void is preferably as large as possible without compromising strength. Most preferably, the passage void is rectangular with the short side being at least approximately 0.125 inches to approximately 0.75 inches. The long side of the passage void is preferably at least 0.25 inches and preferably less than 2 inches. In a particularly preferred embodiment the passage void is approximately 0.25 inches wide and approximately 0.44 inches long.

Figure 5:
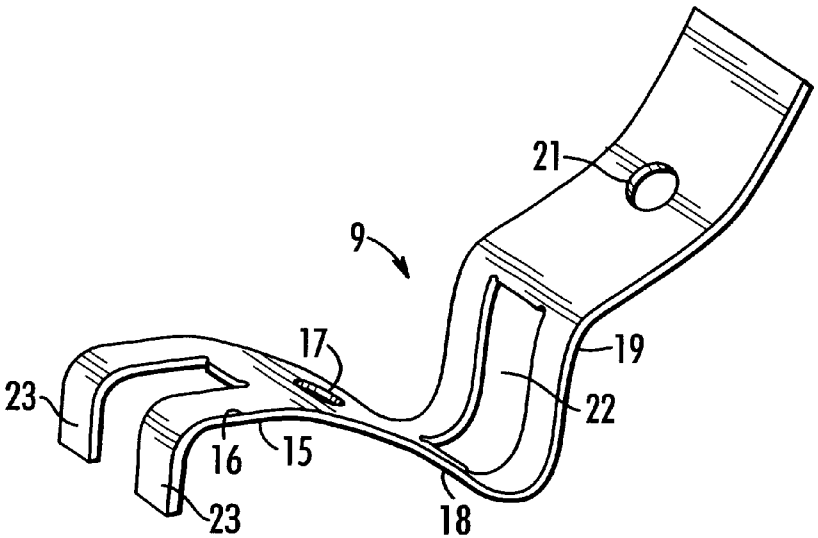
FIG. 5 is a perspective view of a second embodiment of the gutter shield mounting clip of the present invention.
Figure 4:
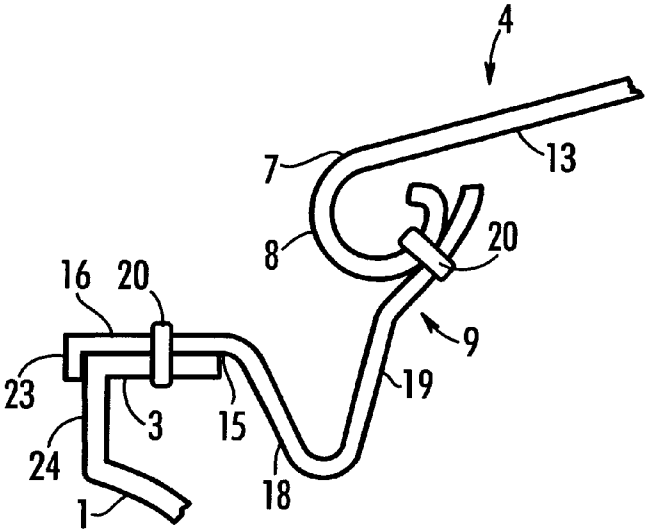
FIG. 4 is a cross-sectional view of a second embodiment of the gutter shield mounting clip of the present invention.

FIGS. 4 and 5 illustrate an embodiment of the present invention. In the embodiment the mounting clip, 9, comprises at least one locating tab, 23, which projects downward from the gutter mounting tab. In a preferred embodiment the locating tab abuts against the face, 24, of the gutter to provide a positive location for placement of the gutter shield. The locating tab is large enough to contact the face of the gutter but is not so large as to detract from the aesthetics of the gutter. A locating tab of approximately 0.06 inches square to no more than 0.5 inches square is sufficient with approximately 0.125 inches square most preferred.

The gutter shield and mounting bracket can be manufactured from any of the materials typically used for the manufacture of gutters. Most preferably, the clip is manufactured from metal such as 316 stainless steel or an equivalent material. The clip is preferably approximately 0.025 inch thick stainless steel since this provides a suitable strength and a long life. The gutter shield is most preferably aluminum since this affords a suitable strength at a low weight. Other materials can be used without departing from the scope of the present invention. In practice aluminum with a thickness of approximately 0.019 inches has proven to be adequate. The gutter shield may be prepared by forming the curl at the site of manufacture since this is a standard practice in the gutter installation industry. The size of the gutter shield varies based on factors such as the size of the gutter, the slope of the roof, etc. In practice a gutter shield of approximately 5 inches wide to approximately 12 inches wide is suitable with a gutter shield of approximately 8 inches wide being suitable for most standard applications. The length of the gutter shield is not limiting but sections 4 feet long are optimum since these can be handled by a single person and still cover a large enough area to expedite the installation process.

The apparatus described herein constitutes the preferred embodiments of the invention. It is understood that the invention is not limited to the form of apparatus as previously described and that changes can be made without departing from the scope of the invention.

What is claimed is:

1. A shield for eliminating debris from entering a gutter comprising:

an elongated gutter shield comprising a curl;

a mounting clip comprising:

a gutter mounting tab;

a downward leg attached to said gutter mounting tab and extending downward therefrom; and a riser leg attached to said downward leg opposite said gutter mounting tab and extending upward therefrom; and wherein said gutter mounting tab is attachable on top of said gutter and said riser leg is attachable to said curl.

2. The shield of claim 1 wherein said mounting clip further comprises a passage void.

3. The shield of claim 2 wherein said passage void is in said downward leg.

4. The shield of claim 2 wherein said passage void is in said riser leg.

5. The shield of claim 1 wherein said mounting clip is at least 0.25 inches wide to no more than 1 inch wide.

6. The shield of claim 5 wherein said mounting clip is at least 0.375 inches wide to no more than 0.625 inch wide.

7. A shield for eliminating debris from entering a gutter comprising:

an elongated gutter shield comprising a curl;

a mounting clip comprising:

a gutter mounting tab;

a downward leg attached to said gutter mounting tab and extending downward therefrom; and a riser leg attached to said downward leg and extending upward therefrom; and wherein said gutter mounting tab is attachable to said gutter and said riser leg is attachable to said curl wherein said mounting clip further comprises at least one alignment tab attached to said gutter mounting tab and projecting downward.

8. A shield for eliminating debris from entering a gutter comprising:

an elongated gutter shield comprising a long edge and a short edge and a curl along one said long edge;

an elongated strap mounting clip comprising:

a planar gutter mounting tab;

a downward leg comprising a first side and a second side wherein said first side is attached to said gutter mounting tab and extending downward therefrom; and a riser leg attached to said second side of said downward leg and extending upward therefrom; and wherein said gutter mounting tab is attachable on top of said gutter and said riser leg is attachable to said curl.

9. The shield of claim 8 wherein said mounting clip further comprises a passage void.

10. The shield of claim 9 wherein said passage void is in said downward leg.

11. The shield of claim 9 wherein said passage void is in said riser leg.

12. The shield of claim 8 wherein said mounting clip is at least 0.25 inches wide to no more than 1 inch wide.

13. The shield of claim 12 wherein said mounting clip is at least 0.375 inches wide to no more than 0.625 inch wide.

14. A shield for eliminating debris from entering a gutter comprising:

an elongated gutter shield comprising a long edge and a short edge and a curl along one said long edge;

an elongated strap mounting clip comprising:

a planar gutter mounting tab;

a downward leg attached to said gutter mounting tab and extending downward therefrom; and a riser leg attached to said downward leg and extending upward therefrom; and wherein said gutter mounting tab is attachable to said gutter and said riser leg is attachable to said curl wherein said mounting clip further comprises at least one alignment tab attached to said gutter mounting tab.

15. A shield for eliminating debris from entering a gutter wherein said gutter comprises an exterior edge and said shield comprises:

an elongated gutter shield comprising a curl;

a mounting clip comprising:

a gutter mounting tab;

a downward leg attached to said gutter mounting tab and extending downward therefrom; and a riser leg attached to said downward leg and extending upward therefrom wherein said downward leg is between said gutter mounting tab and said riser leg; and wherein said gutter mounting tab is attachable to said exterior edge of said gutter and said riser leg is attachable to said curl.

16. The shield of claim 15 wherein said mounting clip is an elongated strap.

17. The shield of claim 15 wherein said curl has a diameter of at least 0.25 inches to no more than 1.0 inches.

* * * * *